US006789681B2

(12) United States Patent
Czerwoniak et al.

(10) Patent No.: US 6,789,681 B2
(45) Date of Patent: Sep. 14, 2004

(54) SCREEN FOR FIBER SUSPENSIONS AND METHOD FOR THE MANUFACTURE THEREOF

(75) Inventors: Erich Czerwoniak, Pfullingen (DE); Wilhelm Hagen Hutzler, Reutlingen (DE); Erwin Mayer, Pfullingen (DE); Jochen Gustav Pfeffer, Eningen (DE)

(73) Assignee: Voith Paper Patent GmbH, Heidenheim (DE)

( * ) Notice: Subject to any disclaimer, the term of this patent is extended or adjusted under 35 U.S.C. 154(b) by 238 days.

(21) Appl. No.: 10/219,209

(22) Filed: Aug. 15, 2002

(65) Prior Publication Data

US 2002/0189994 A1 Dec. 19, 2002

Related U.S. Application Data

(63) Continuation of application No. PCT/EP00/01385, filed on Feb. 19, 2000.

(51) Int. Cl.[7] ..... B07B 1/49

(52) U.S. Cl. ..... 209/405; 29/522.1; 29/896.62; 209/407; 209/409; 210/498; 210/499

(58) Field of Search ..... 29/505, 515, 522.1, 29/896.62; 209/305, 393, 395, 405, 406, 407, 409, 410, 411

(56) References Cited

U.S. PATENT DOCUMENTS

| | | | | | |
|---|---|---|---|---|---|
| 4,077,717 | A | * | 3/1978 | Lange | 355/133 |
| 5,090,721 | A | | 2/1992 | Lange | |
| 5,234,550 | A | * | 8/1993 | Ekholm et al. | 162/251 |
| 5,259,512 | A | * | 11/1993 | Czerwoniak | 209/273 |
| 5,566,833 | A | * | 10/1996 | Pfeffer et al. | 209/273 |
| 5,601,192 | A | * | 2/1997 | Hutzler et al. | 209/273 |
| 6,029,825 | A | * | 2/2000 | Pfeffer et al. | 210/414 |
| 6,047,834 | A | | 4/2000 | Dolle et al. | |
| 6,131,743 | A | * | 10/2000 | Czerwoniak et al. | 209/406 |

FOREIGN PATENT DOCUMENTS

| | | |
|---|---|---|
| EP | 0499154 A | 8/1992 |
| EP | 0808941 A | 11/1997 |
| WO | WO 98/57723 A | 12/1998 |

* cited by examiner

*Primary Examiner*—John Kim
(74) *Attorney, Agent, or Firm*—Leydig, Voit & Mayer, Ltd.

(57) ABSTRACT

In the rotationally symmetrical screen for fiber suspensions with a series of straight profiled bars which extend the direction of the screen axis and form slot-shaped screen openings between them, and with several ring-shaped profiled bar supports lying in planes extending perpendicularly to the screen axis, each of the profiled bar supports having in its edge region adjacent to the inlet side of the screen a series of cutouts opening towards the inlet side of the screen for insertion of the profiled bars, with the shape of these cutouts corresponding to the configuration of the cross-sectional regions of the profiled bars held positively in these cutouts, in order to simplify insertion of the profiled bars into the cutouts of the profiled bar supports each profiled bar has for each profiled bar support a recess which decreases the width of this cross-sectional region of the profiled bar, and the recesses lie outside the profiled bar supports in the finished screen.

23 Claims, 8 Drawing Sheets

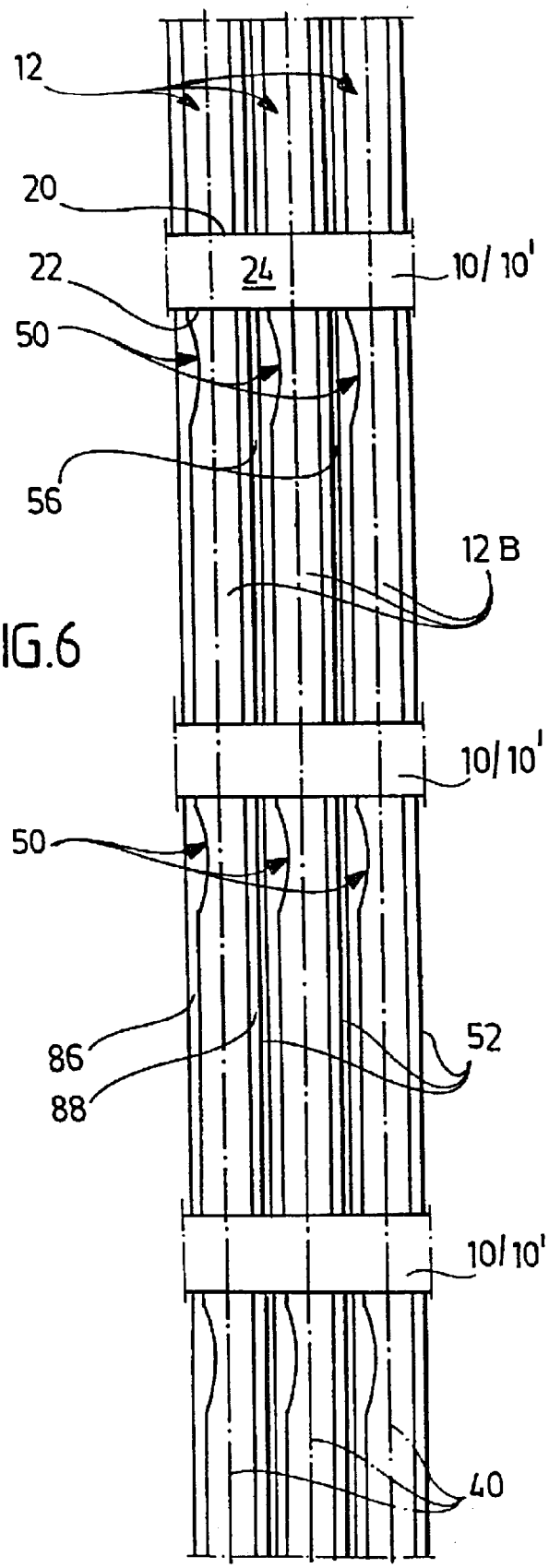
FIG.6
FIG.7
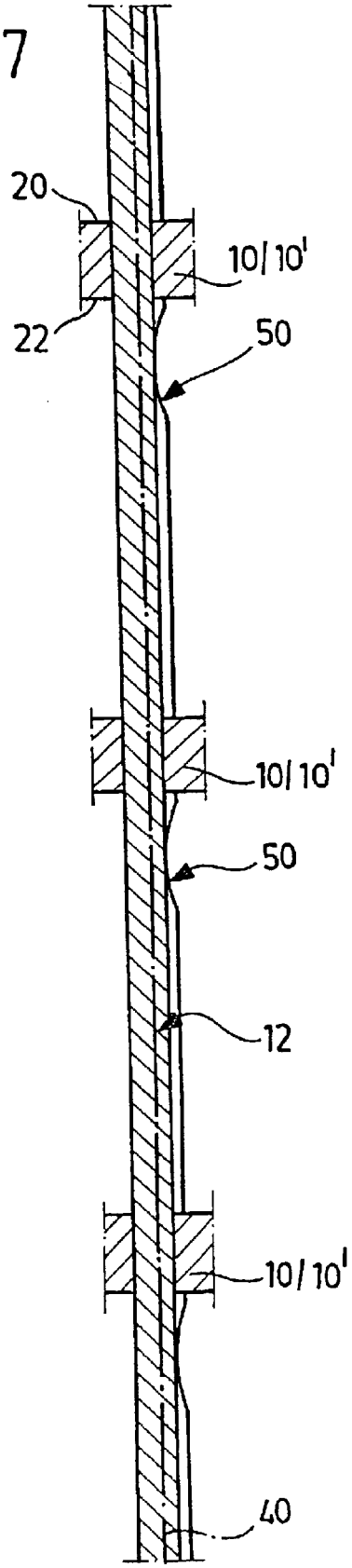

SCREEN FOR FIBER SUSPENSIONS AND METHOD FOR THE MANUFACTURE THEREOF

This is a continuation of International Application No. PCT/EP00/01385, with an International filing date of Feb. 19, 2000, published in German under PCT Article 21(2) which is incorporated herein by reference in its entirety and for all purposes.

BACKGROUND OF THE INVENTION

The invention relates to a screen for fiber suspensions, more specifically, to a screen of the type (so-called bar screen basket) that is the subject matter of WO 98/57723 of the company Hermann Finckh Maschinenfabrik GmbH & Co.

Such a cylindrical or possibly also conical screen of rotationally symmetrical shape in relation to a screen axis has several ring-shaped profiled bar supports (also referred to as supporting rings) arranged at spacings from one another in the direction of the screen axis and lying in planes extending perpendicularly to the screen axis, and these profiled bar supports are provided at their inner or outer circumference, mostly at the inner circumference, with a ring of cutouts arranged at spacings from one another in the circumferential direction and opening towards this circumference of the supports. Viewed in the direction of the screen axis, the cutouts of the ring-shaped profiled bar supports lie over one another so as to enable straight profiled bars to be inserted into these cutouts and held therein. These profiled bars extend transversely to the circumferential direction of the screen, are arranged at spacings from one another in the circumferential direction of the screen and form between them slot-shaped screen openings of identical width which are interrupted by the ring-shaped profiled bar supports. All the profiled bars usually have the same configuration (the spacings of the supporting ring cutouts from one another are then all of the same size) and have a cross section of elongate shape, with the longitudinal direction of the profiled bar cross section being at least approximately radially oriented in relation to the screen axis. However, profiled bars of different configuration may also be used and arranged at such spacings from one another that the slot-shaped screen openings nevertheless are all of the same width. With an end region of the profiled bar cross section each profiled bar is inserted into a respective cutout of each one of the profiled bar supports, and, viewed in the direction of the screen axis, the shape of these cutouts corresponds to the configuration of this cross section end region of the profiled bars and forms at a radial spacing from the open end of the cutout an undercut in which a projection of the profiled bar cross section engages so that the profiled bars are positively held in the cutouts of the profiled bar supports, both in a radial direction in relation to the screen axis and in the circumferential direction of the screen. In the manufacture of such a screen, the profiled bar supports provided with the cutouts may initially be present in the form of straight bars or rails which after insertion of the profiled bars into the cutouts are bent into closed supporting rings so as to thereby clamp the profiled bars in the supporting ring cutouts when the cutouts are located at that side of the profiled bar supports which later forms the inner circumference of the supporting rings. As described in WO 98/57723, the straight or ring-shaped profiled bar supports may, however, also undergo such plastic deformation on that side of the profiled bars facing away from the open ends of the cutouts that as a result of displacement of profiled bar support material in the direction towards the profiled bars, their projections are pressed against the undercuts formed by the cutouts, and the profiled bars are thereby fixed in the supporting rings-this measure can be taken in both initially ring-shaped profiled bar supports and initially straight profiled bar supports, and, in the latter case, before or after the profiled bar supports are bent into closed supporting rings.

In the manufacture of the known screens disclosed WO in 98/57723, a fundamental problem arises in connection with insertion of the profiled bars into the profiled bar supports, irrespective of whether the profiled bars are inserted into the cutouts of still straight profiled bar supports or into the cutouts of supporting rings: As the profiled bar support cutouts each form an undercut in which a projection of the profiled bar cross section engages, the profiled bars must either be pushed into the profiled bar support cutouts in the longitudinal direction of the profiled bars or snapped into these cutouts transversely to the longitudinal direction of the profiled bars. In the former case, the insertion of the relatively long and thin profiled bars involves considerable difficulties as the profiled bars are to be held with a snug fit in the profiled bar support cutouts, which results in a high slide resistance, and, in the latter case, when snapping the profiled bars into the profiled bar support cutouts, if not a plastic deformation, then at least a considerable elastic deformation occurs in the webs of the profiled bar supports located between the profiled bar support cutouts. Even if these webs of the profiled bar supports only undergo elastic deformation when snapping in the profiled bars and thereby widening the profiled bar support cutouts, upon inserting the last profiled bar into the profiled bar supports the webs of the profiled bar supports adjacent to this profiled bar are unable to deviate or deflect at least to any appreciable extent towards both sides, quite apart from the fact that the snapping of the other profiled bars into the profiled bar support cutouts requires considerable forces if the profiled bars are to be held in a clamped and snugly fitting manner in the profiled bar support cutouts in the finished screen. The problems described hereinabove conflict, above all, with automated assembly of the screens.

The object underlying the invention was to create a screen of the generic kind as described in WO 98/57723 or in any of the publications (EP-B-0 417 408 and EP-A-0 499 154) mentioned in this document, which is easier to assemble than these known screens (bar screen baskets) and which basically opens up the possibility of automated assembly of the profiled bars in or on the profiled bar supports.

SUMMARY OF THE INVENTION

This object is accomplished in accordance with the invention by a screen in accordance with claim 1 and by a manufacturing method in accordance with claim 20.

The invention thus relates to a screen for fiber suspensions having a shape which is essentially rotationally symmetrical in relation to a screen axis, with a first and a second circumferential side, one of which forms an inlet side and the other an outlet side of the screen for the fiber suspension, with a series of straight profiled bars arranged at spacings from one another in the circumferential direction of the screen, extending transversely to the circumferential direction of the screen and forming slot-shaped screen openings of identical width between them, the cross sections of the profiled bars each having an elongate shape with a first end region facing away from the second circumferential side of the screen and a second end region facing away from the first circumferential side of the screen, and with several ring-shaped profiled bar supports arranged at spacings from one another in the direction of the screen axis and lying in planes extending perpendicularly to the screen axis, each of the profiled bar supports having in its first edge region facing away from the second circumferential side of the screen a series of cutouts opening towards the first circumferential side of the screen, the shape of the cutouts-viewed in the direction of the screen axis-corresponding to the configuration of the second cross-sectional end regions of the profiled bars lying in these cutouts, and forming at a radial spacing from the first edge of the profiled bar support facing the first circumferential side of the screen an undercut in which a projection of the profiled bar cross section engages so that the profiled bars are held positively in a radial direction in relation to the screen axis and in circumferential direction of the screen with their second cross-sectional end regions in the profiled bar support cutouts, with the profiled bars preferably projecting with their first cross-sectional end regions in a radial direction over the first edges of the profiled bar supports. In accordance with the invention it is proposed that such a screen be configured such that the second cross-sectional end region of each profiled bar has for each profiled bar support a recess which decreases the width of the second cross-sectional end region measured in the circumferential direction of the screen, and the recesses of each profiled bar are arranged at spacings from one another corresponding to the spacings of the profiled bar supports and are located outside the profiled bar supports in the finished screen, and that the profiled bar recesses are of such configuration that the areas of the second cross-sectional end regions of the profiled bars provided with these recesses are insertable transversely to the longitudinal direction of the pertinent profiled bar into the profiled bar support cutouts at least without any substantial plastic deformation of the profiled bar supports and/or the profiled bars. Outside their recesses the profiled bars preferably have the same cross section over all (in shape and size). Furthermore, embodiments are preferred which all the profiled bars are of identical design.

To manufacture such a screen, it is proposed in accordance with the invention that the profiled bars be inserted with their areas provided with the recesses into the cutouts of the profiled bar supports in a direction perpendicular to the longitudinal direction of the profiled bars, and the profiled bar supports and the profiled bars then be displaced relative to one another in the longitudinal direction of the profiled bars such that the profiled bar recesses lie outside the profiled bar supports and the second cross-sectional end regions of the profiled bars lie at least substantially free of play in the profiled bar support cutouts.

The invention makes it possible to push the profiled bars into the cutouts of the profiled bar supports transversely to their longitudinal direction at least almost without resistance, whereupon the profiled bars and the profiled bar supports only have to be displaced slightly relative to one another in the longitudinal direction of the profiled bars in order to secure the profiled bars in the profiled bar support cutouts. As both procedures can be carried out by relatively slight movements of the profiled bars and/or the profiled bar supports, without having to overcome any appreciable resistances, the invention also makes it possible to automate assembly of a screen according to the invention without having to fear that the relatively long and thin profiled bars and/or the profiled bar supports will be bent.

In so-called pressure sorters for fiber suspensions comprising a rotationally symmetrical, basket-like screen (albeit open at the top and bottom) and a rotor which rotates about the screen axis and is either arranged within the screen basket on its outer side (by comprising, for example, blade-like elements which run past the outer side of the screen basket), the screen is subjected to considerable pressure loads. These pressure loads are due, firstly, to the fiber suspension to be treated being supplied to the pressure sorter under, and, in addition, to positive and negative pressure pulses being generated in the fiber suspensions, adjacent to the circumferential wall of the screen, by elements provided on the rotor, and the higher the so-called material density of the fiber suspension (material density is understood as the solids content of the fiber suspension, which is formed by fibers and impurities contained in the fiber suspension), the stronger are these alternating pressure loads on the screen wall. The profiled bars between the profiled bar supports are subjected to bending by these pressure loads. It has, however, been found that the necessary resistance of the profiled bars to these pressure loads is virtually unimpeded by the recesses to be provided on the profiled bars in accordance with the invention, if in the finished screen profiled bar recesses lie in the vicinity of the profiled bar supports. In preferred embodiments of the screen according to the invention, all the profiled bar recesses are arranged immediately adjacent to the profiled bar supports because the weakening of the profiled bars by their recesses with respect to the resistance of the screen to the pressure loads described hereinabove is insignificant.

In order that the profiled bars will be insertable into the profiled bar support cutouts at least substantially without resistance, it is recommended that the length of the profiled bar recesses measured in the longitudinal direction of the profiled bars be the same as or slightly larger than the thickness of the profiled bar supports measured in the direction of the screen axis.

In order to avoid the occurrence of an undesired notch effect on the profiled bars—such notch effects increase the risk of breakage of the screen under the influence of the pressure loads described hereinabove—preferred embodiments of the screen according to the invention are characterized in that each profiled bar recess (in a side view of the pertinent profiled bar) passes over without any edges into the profiled bar areas adjacent to the recess in the longitudinal direction of the profiled bar. In particular, a concave recess end region adjoins the actual profiled bar recess (in the longitudinal direction of the profiled bar) on both sides so as to ensure a smooth and continuous transition of the recess into the adjacent, unweakened areas of the profiled bar. In such embodiments, it will be advantageous to make the length of the actual profiled bar recess measured in the longitudinal direction of the profiled bar (without the recess end regions mentioned hereinabove) the same size as the thickness of the profiled bar supports measured in the direction of the screen axis.

If in the manufacture of the screen according to the invention, the profiled bars are inserted into cutouts of straight profiled bar supports and the latter are then bent into circular supporting rings closed within themselves so that the cutouts of the profiled bar supports are located at the inner circumference of the supporting rings, the internal tension of the profiled bars in the profiled bar support cutouts which accompanies the bending may be adequate to secure the profiled bars against longitudinal displacements relative to the profiled bar supports. If the profiled bars are inserted into cutouts of profiled bar supports which are already ring-shaped, various measures could be taken to secure the profiled bars against longitudinal displacement. For example, stop rings for the profiled bars could be provided at both axial ends of the screen, and these and also the profiled bar supports could be joined to one another by, for example, welded-on bars extending in the direction of the screen axis. However, a different securing measure, which is the subject matter of the above-mentioned WO 98/57723 of the company Hermann Finckh Maschinenfabrik GmbH & Co is preferred, according to which preferred embodiments of the screen according to the invention are characterized in that the profiled bar supports have such deformed areas at the side of the profiled bars facing the second circumferential side of the screen that as a result of a displacement of profiled bar support material in the direction towards the first circumferential side of the screen, the profiled bar projections are pressed in this direction against the undercuts formed by the profiled bar cutouts.

Further improvements of this securing measure will be apparent from WO 98/57723. Mention is also made of the fact that the securing of the profiled bars against longitudinal displacements by deformation of the profiled bar supports can be carried out not only on ring-shaped profiled bar supports but also on still straight, profiled bar supports which already hold the profiled bars and are subsequently shaped into supporting rings.

Further improvements of the screen according to the invention and of the method according to the invention for manufacture thereof will be apparent from the attached claims and the appended drawings as well as the following description of a preferred embodiment of the screen according to the invention.

BRIEF DESCRIPTION OF THE DRAWINGS

FIG. 6 is a view of three profiled bars and three profiled bar supports, viewed in the direction of arrow B in FIG. 1, with FIG. 6 showing only relatively short sections of the profiled bar supports and the profiled bars not in their full length;

FIG. 7 is a section through a profiled bar and through short sections of three profiled bar supports corresponding to line 7—7 in FIG. 3;

DETAILED DESCRIPTION OF THE INVENTION

Figure 1:
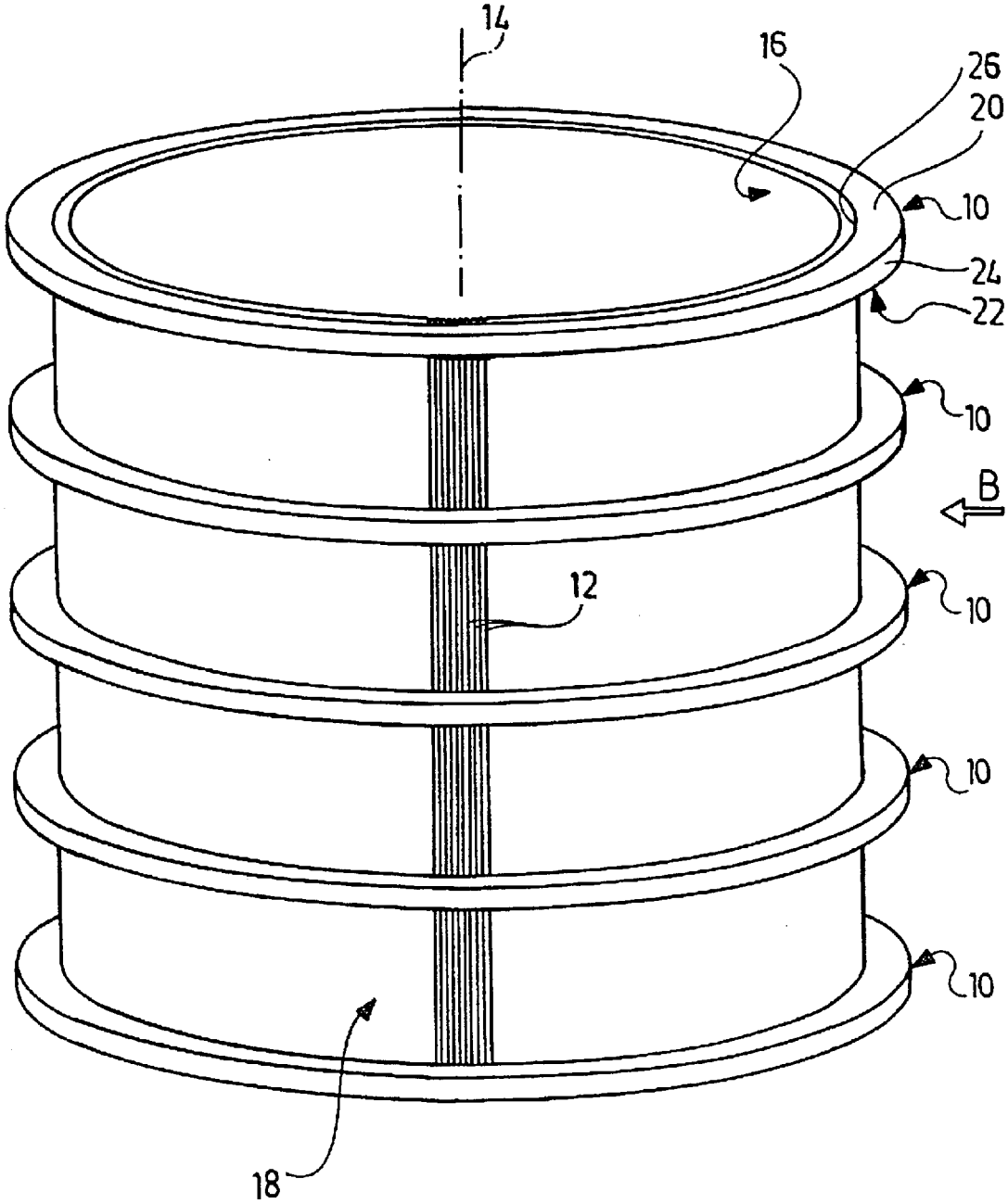
FIG. 1 is a perspective and mainly diagrammatic representation of the preferred embodiment of the screen according to the invention (referred to hereinbelow as bar screen basket), in which only a few profiled bars are shown.
Figure 2:
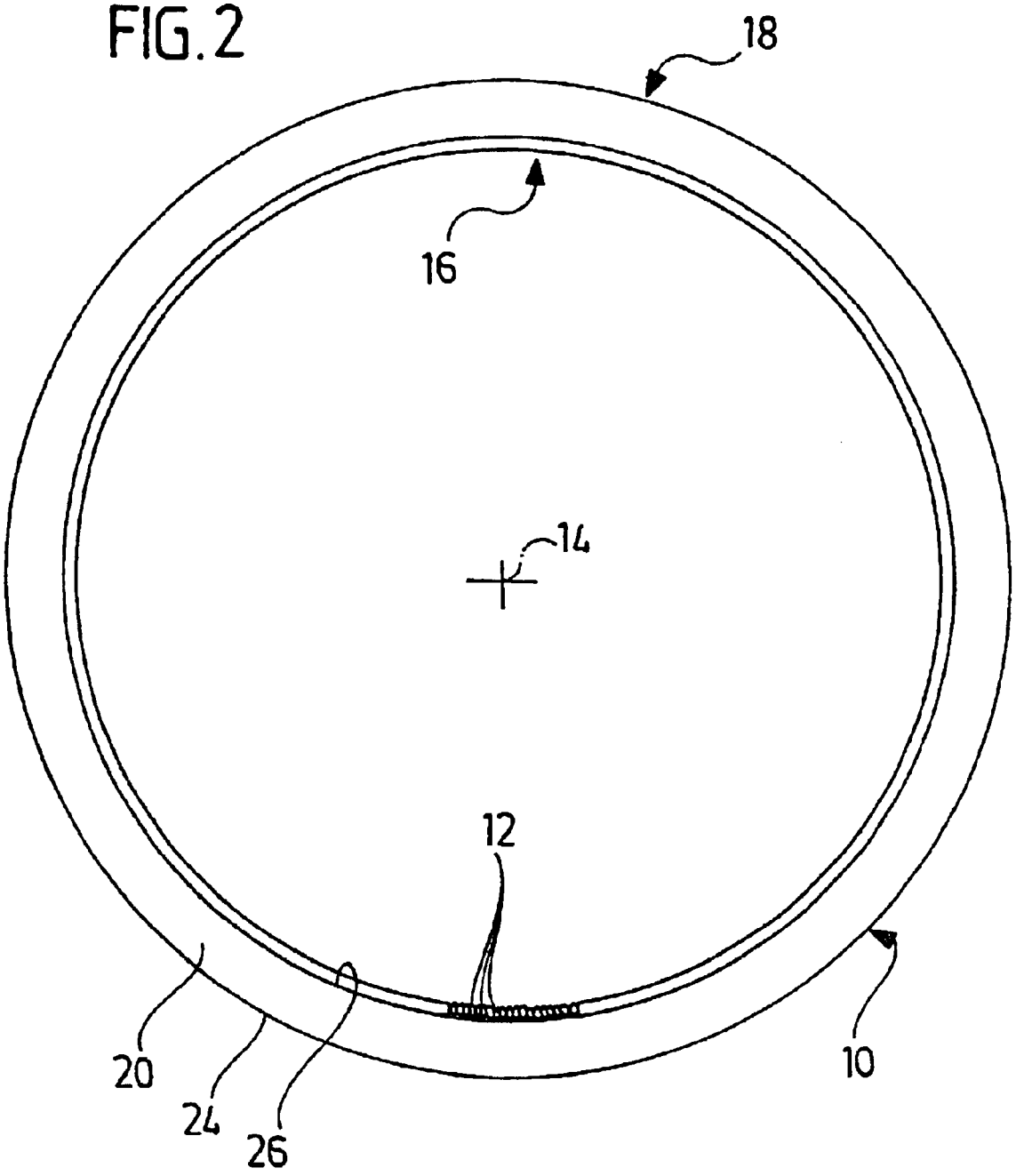
FIG. 2 is a plan view, again mainly diagrammatic, of the bar screen basket shown in FIG. 1, in which, again, only a few profiled bars are indicated.

From FIGS. 1 and 2 it is apparent that the screen according to the invention, which is designed as a bar screen basket, consists of several profiled bar supports in the form of supporting rings 10 and of a series of profiled bars 12. The profiled bars 12 extend parallel to a screen axis 14, and the supporting rings 10 lie in planes perpendicular to the screen axis and are arranged at equidistant spacings from one another. In the illustrated preferred embodiment of the screen according to the invention, the profiled bars 12 are designed and arranged such that the inlet side 16 of the screen for the fiber suspension to be sorted lies at the inner circumference of the screen basket, and the outlet side 18 for the fiber suspension which has passed through the screen basket at the outer circumference of the screen basket. Each of the, in particular, identically designed supporting rings 10 has a cross section in the form of a flat rectangle and possesses an upper flat side 20, a lower flat side 22, an outer edge 24 and an inner edge 26.

Figure 3:
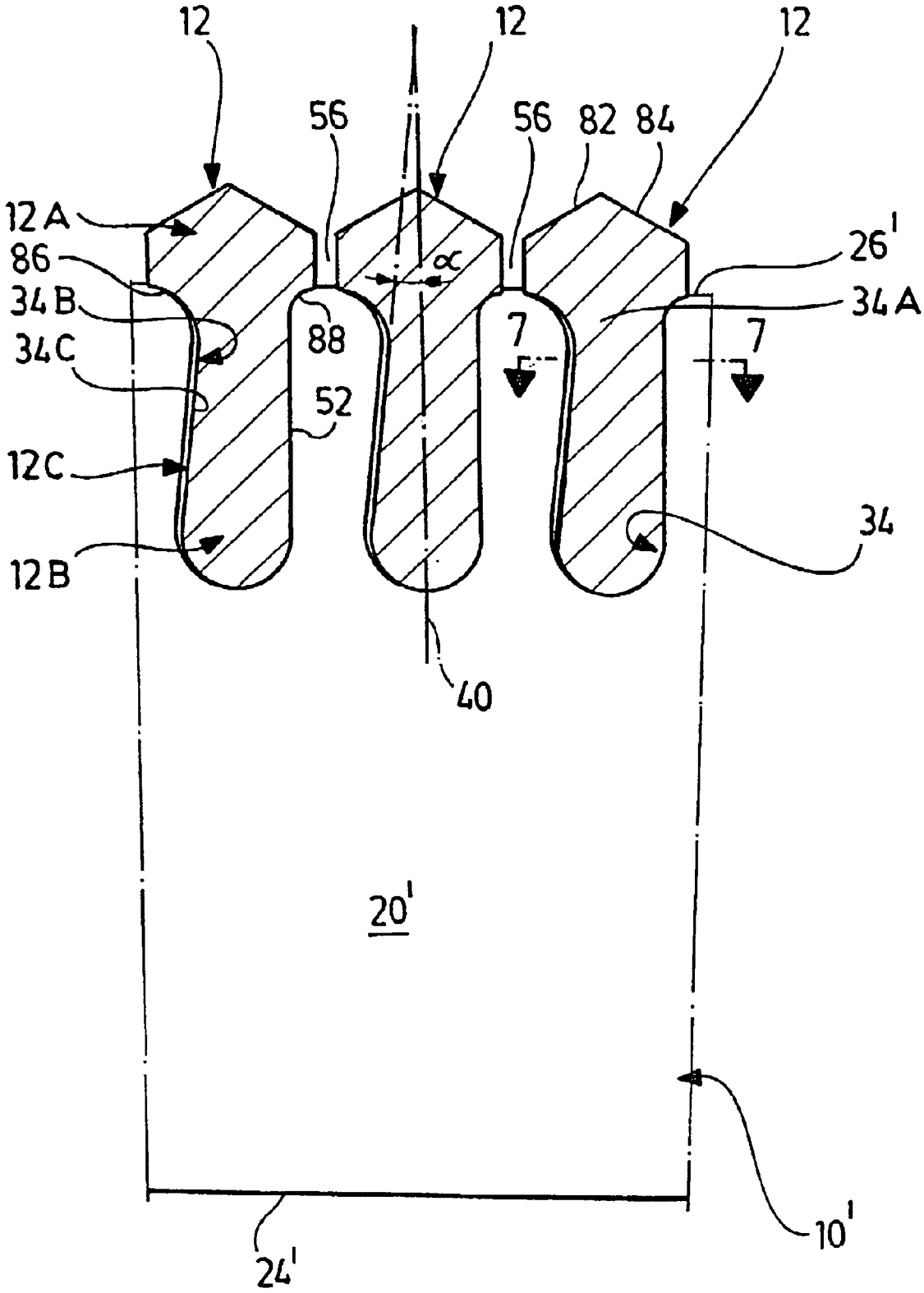
FIG. 3 is a plan view of a relatively short section of a still straight profiled bar support with three profiled bars shown in cross section, which have already been inserted into cutouts in the profiled bar support, but have not yet been fixed thereon in the longitudinal direction of the profiled bars by a plastic deformation of the profiled bar support.

FIG. 3 shows a short section of a still straight profiled bar support 10' which is later to be shaped into a closed supporting ring 10 by bending and, for example, welding its ends together. The first edge of the profiled bar support 10' corresponding to the inner edge 26 of the supporting ring 10 was designated 26', the second edge of the profiled bar support 10' corresponding to the outer edge 24 of the supporting ring 10 was designated 24', and the upper flat side of the profiled bar support 10' visible in FIG. 3 was designated 20'. For each profiled bar 12 the profiled bar support 10' has a cutout 34 in which a profiled bar 12 is held with a positive fit in the longitudinal direction of the profiled bar support 10' and in the direction perpendicular to this longitudinal direction and lying in the drawing plane of FIG. 3, albeit with relatively little play apparent from FIG. 3. In the preferred embodiment of the screen according to the invention, all profiled bars 12 are to have the same configuration and the same dimensions, and the same also applies to the supporting rings 10 or to the still straight profiled bar supports 10', but, in particular, to their cutouts 34. Outside the profiled bar recesses according to the invention, which will be discussed hereinbelow, the profiled bars have the same cross section all over, shown in FIG. 3, the configuration of which is preferably approximately mushroom-shaped with a mushroom head forming a first cross-sectional end region 12A and an approximately club-shaped mushroom foot forming a second cross-sectional end region 12B, with the configuration of the second cross-sectional end region 12B corresponding to the configuration of the cutout 34 if one disregards the play of the profiled bars 12 in the cutouts 34 of the still straight profiled bar supports 10', which is apparent from FIG. 3.

The shape of each of the cutouts 34 whose flanks extend perpendicularly to the upper and lower flat sides of the profiled bar support 10' is designed in accordance with the invention such that the cutout 34 has a constriction 34A.

Between the constriction 34A and the end of the cutout 34 facing the second edge 24' of the profiled bar support 10' the cutout 34 forms an undercut 34B, in the region of which the edge of the cutout 34 has an approximately straight flank 34C which forms with a plane designated 40 in FIG. 3 and extending perpendicularly to the drawing plane of FIG. 3 an acute angle $\alpha$ which opens in the direction towards the second edge 24' of the profiled bar support 10'. After the profiled bar support 10' has been shaped into a closed supporting ring 10, the plane 40 forms a diameter plane of the bar screen basket.

The second cross-sectional end region 12B of the profiled bars 12 forms a projection 12C which engages the undercut 34B of the associated cutout 34 and so even prior to deformation of the profiled bar support 10', the profiled bars 12 cannot be pulled upwards (in accordance with FIG. 3) out of the cutouts 34. As is also apparent from FIG. 3, each profiled bar 12 lies with that part of its outer circumference which delimits its first cross-sectional end region 12A against the first edge 26' of the profiled bar supports 10' so that the profiled bars 12 are also not displaceable downwards (in accordance with FIG. 3) relative to the profiled bar supports 10'.

Figure 4:
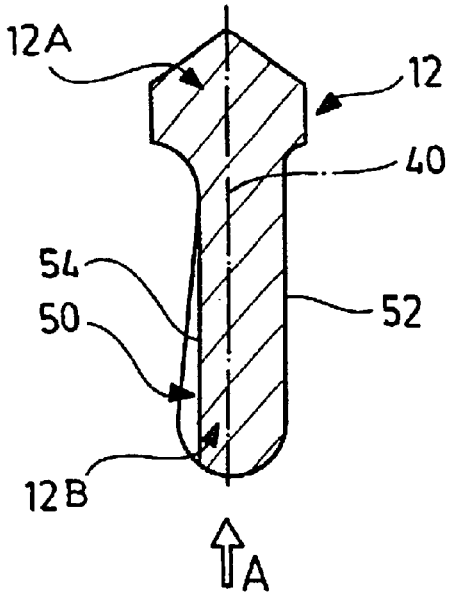
FIG. 4 is a section through a profiled bar designed in accordance with the invention, with the cutting plane extending perpendicularly to the longitudinal direction of the profiled bar and through the longitudinal center of a profiled bar recess according to the invention.
Figure 5:
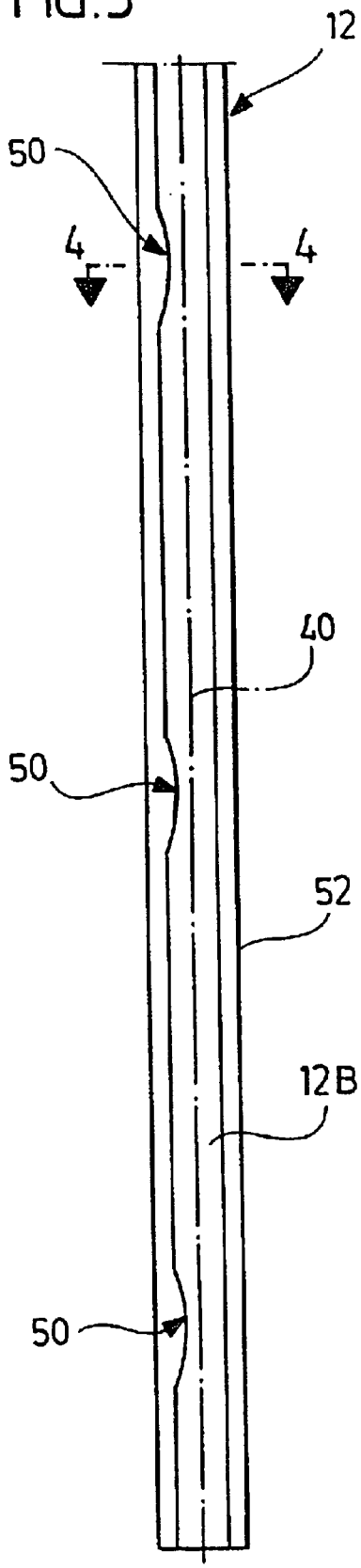
FIG. 5 is a view of the rear side of a profiled bar (view in the direction of arrow A in FIG. 4), with the cutting plane of FIG. 4 indicated by line 4—4 in FIG. 5.

As is apparent from FIGS. 4 and 5, each profiled bar 12 has at one side thereof, namely at a side of its second cross-sectional end region 12B, several trough-shaped recesses 50 arranged at spacings from one another in the longitudinal direction of the profiled bars corresponding to the spacings of the supporting rings 10 measured in the direction of the screen axis 14. The recesses 50 are designed as substantially concave troughs or grooves whose longitudinal axis extending perpendicularly to the drawing plane of FIG. 5 extends perpendicularly to the longitudinal axis of the pertinent profiled bar and in the finished screen basket radially in relation to the screen axis 14, while the longitudinal direction of the cross section of the recesses 50 extends parallel to the longitudinal direction of the profiled bars, so that the recesses 50 are arranged approximately parallel to the plane 40, indicated in FIGS. 4 and 5, which also forms the longitudinal center plane of the profiled bar 12. In the section shown in FIG. 4 extending perpendicularly to the longitudinal direction of the profiled bars through the center of a profiled bar recess 50 and through the lowest point of the recess 50, the second cross-sectional end region 12B of the profiled bar 12 is delimited in the longitudinal direction of the profiled bar supports 10' or in the circumferential direction of the supporting rings 10 by two flanks 52 and 54 which extend parallel to the plane 40 and are spaced from one another perpendicularly to this plane at a distance which corresponds to the smallest width of the cutouts 34 of the profiled bar supports or the supporting rings-the distance of the two flanks 52 and 54 from one another is thus equal to or slightly smaller than the width of the constriction 34A (see FIG. 3), which is the smallest width of the cutouts 34 measured in the longitudinal direction of the profiled bar supports 10' or in the circumferential direction of the supporting rings 10. It is of advantage for the recesses 50 to be designed such that at their locations the second cross-sectional end regions 12B of the profiled bars 12 are slidable in accordance with FIG. 3 from above into the cutouts 34 without the profiled bars and/or the profiled bar supports 10' or the supporting rings 10 undergoing any considerable elastic or even plastic deformation. For this purpose, the recesses 50 are designed so as to have their greatest depth over a length, measured in the longitudinal direction of the profiled bars, which is equal to the thickness of the supporting rings 10 measured in the direction of the screen axis 14. On both sides of this deepest area of a recess 50, concave recess edge regions adjoin this area in the longitudinal direction of the profiled bars so that in accordance with the invention the cross sections of the actual recesses 50 are without corners or edges so to prevent notch effects on the profiled bars-such notch effects would lead to the risk of the profiled bars breaking when subjected to the alternating bending stresses described hereinabove during operation of a pressure sorter.

To attach the profiled bars 12 to the profiled bar supports 10' or the supporting rings 10, the profiled bars are first pushed with the regions thereof which are weakened by the recesses 50 into the cutouts 34 (from above in accordance with FIG. 3), so that the second cross-sectional end regions 12B of the profiled bars come to rest in the cutouts 34, and the profiled bars are then displaced relative to the profiled bar supports or the supporting rings in the longitudinal direction of the profiled bars so that the recesses 50 lie immediately adjacent to the profiled bar supports or supporting rings, as shown in FIGS. 6 and 7—the unweakened second cross-sectional end regions 12B of the profiled bars 12 are then held with a positive fit in the cutouts 34, if one disregards slight play which may initially still be present, as indicated in FIG. 3, between the profiled bars and the profiled bar supports or supporting rings.

FIGS. 3 and 6 also show the slot-shaped screen openings 56 which then lie between the mushroom-head-like first cross-sectional end regions 12A of the profiled bars 12, extend in the longitudinal direction of the profiled bars 12 or in the direction of the screen axis 14, are interrupted by the profiled bar supports 10' or the supporting rings 10, all extend parallel to one another and all have the same width (measured in the longitudinal direction of the profiled bar supports 10' or in the circumferential direction of the supporting rings 10).

Insofar as present, the narrow gap indicated in FIG. 3 between the flank 34C of the cutouts 34 and the projection 12C of the profiled bars 12 can be closed and eliminated by shaping the initially straight profiled bar supports 10' into supporting rings 10 having the shape of circular rings, namely such that the profiled bars 12 lie at the inner circumference of the supporting rings 10. Alternatively or additionally, however, clamping of the profiled bars 12 in the cutouts 34 may also be brought about as is described and illustrated in WO 98/57723 and as is to be the case in the preferred embodiment of the screen according to the invention. This procedure will now be explained with reference to FIGS. 8 to 10.

Figure 9:
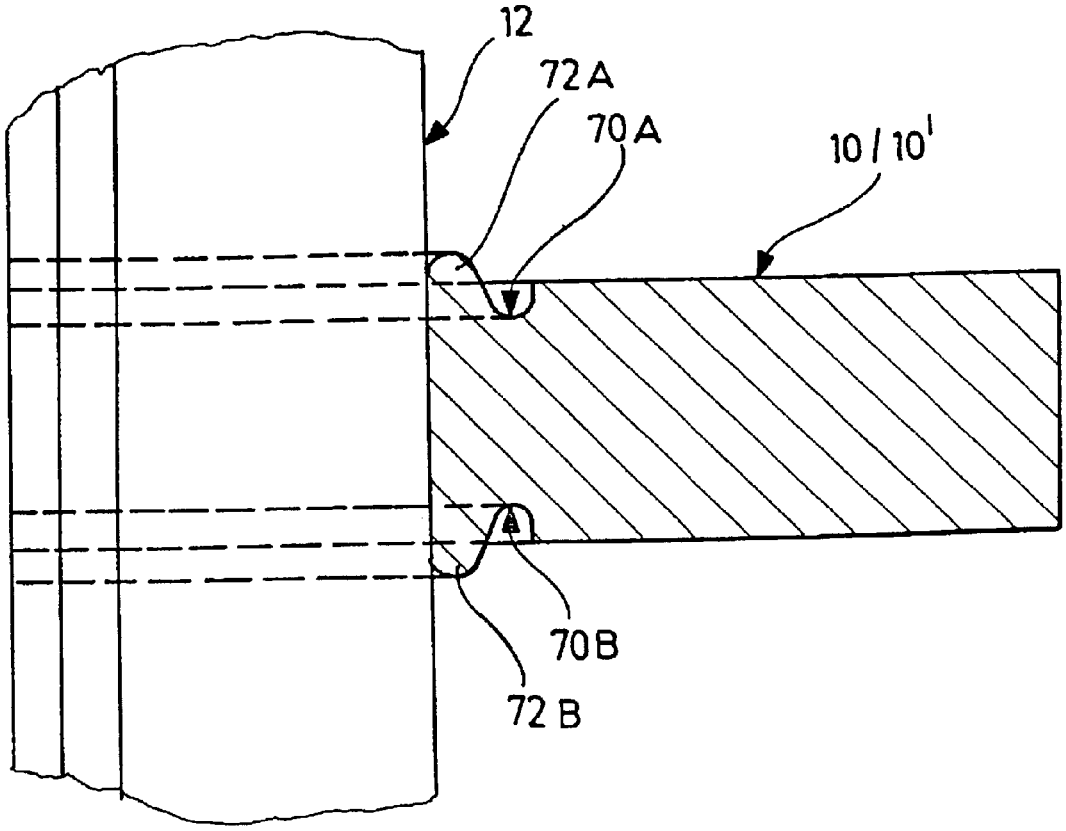
FIG. 9 is a section taken on line 9—9 in FIG. 8.
Figure 10:
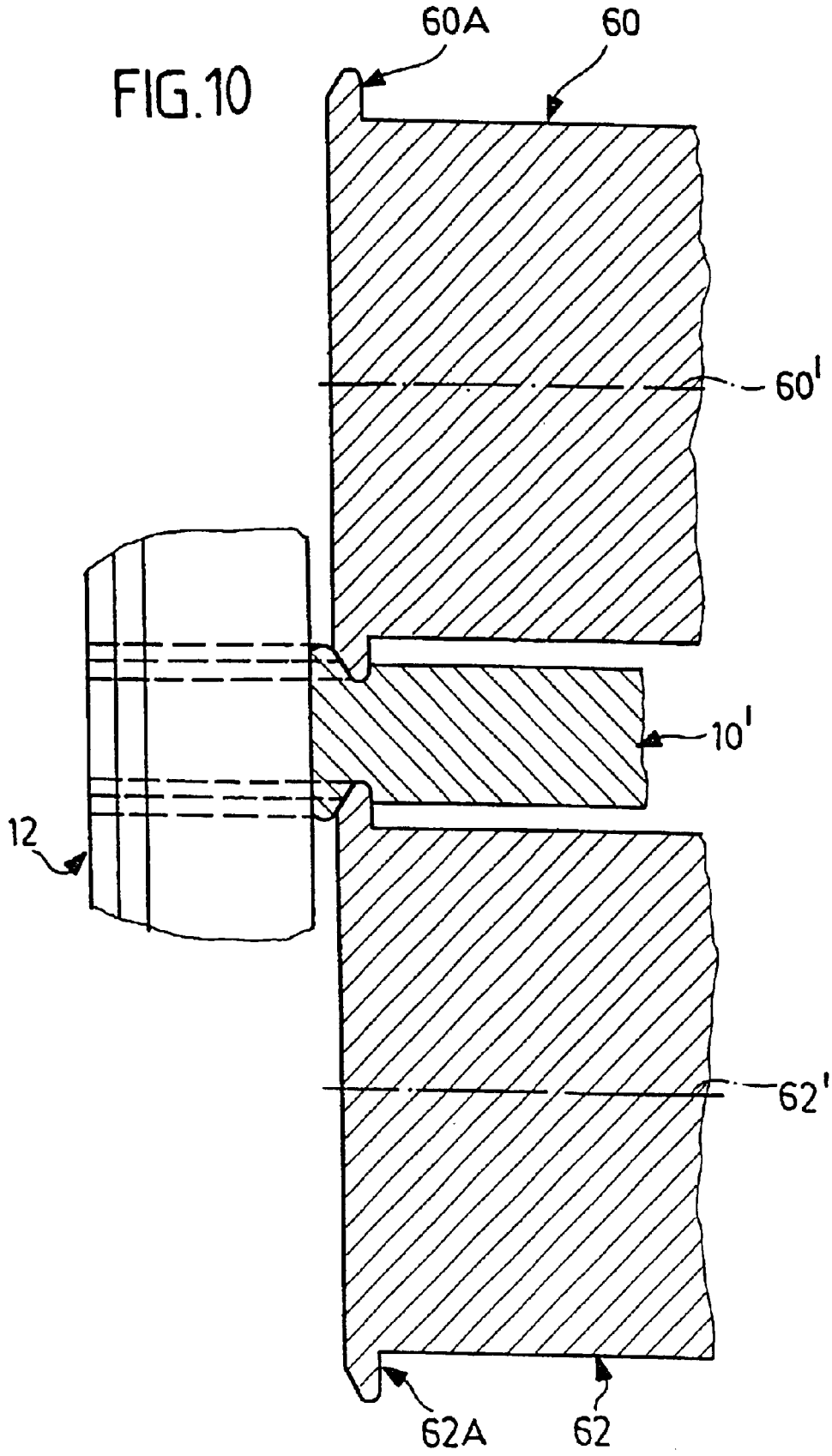
FIG. 10 is a representation corresponding to FIG. 9, but including two rolling tools for the inventive plastic deformation of the profiled bar support.

An upper pressure roll 60 is pressed from above and a lower pressure roll 62 from below (see FIG. 10) against the profiled bar support 10'(or against a supporting ring 10) shown in FIGS. 8 to 10. The pressure rolls are freely rotatable about axes 60' and 62', respectively, parallel to one another and to the flat sides of the profiled bar support 10'. These axes also extend perpendicularly to the longitudinal direction of the profiled bar support 10' and radially to the screen axis 14. While controlling the pressure with which they are pressed in accordance with FIG. 10 in the vertical direction against the profiled bar support 10' or the supporting ring 10, the pressure rolls 60 and 62 are guided past all of the profiled bars 12 along the profiled bar support 10' or around the supporting ring 10 and thus produce with their displacement ribs 60A and 62A, respectively, apparent from FIG. 10, at the upper and lower flat sides of the profiled bar support 10' or the supporting ring 10 in the immediate vicinity of the profiled bars 12 a channel 70A and 70B, respectively, and owing to the inventive configuration of the profile of the displacement ribs 60A and 62A, respectively, apparent from FIG. 10, a bead 72A and 72B, respectively, cast up against the profiled bars 12, so that owing to this displacement of material the profiled bars 12 are displaced upwards to a slight extent in accordance with FIG. 3

(including the lower edge area of each of the cutouts 34 in accordance with FIG. 3). Owing to this displacement of material, the previously present gap between the flanks 34C of the cutouts 34 and the projections 12C of the profiled bars 12 is closed or eliminated, as is apparent from FIG. 8, with the result that the profiled bars 12 are firmly clamped in the cutouts.

The angle $\alpha$ apparent from FIG. 3 is expediently of such dimensions that after the deformation according to the invention, self-locking occurs between the flanks 34C and the flanks of the profiled bar projections 12C pressed against these.

Figure 8:
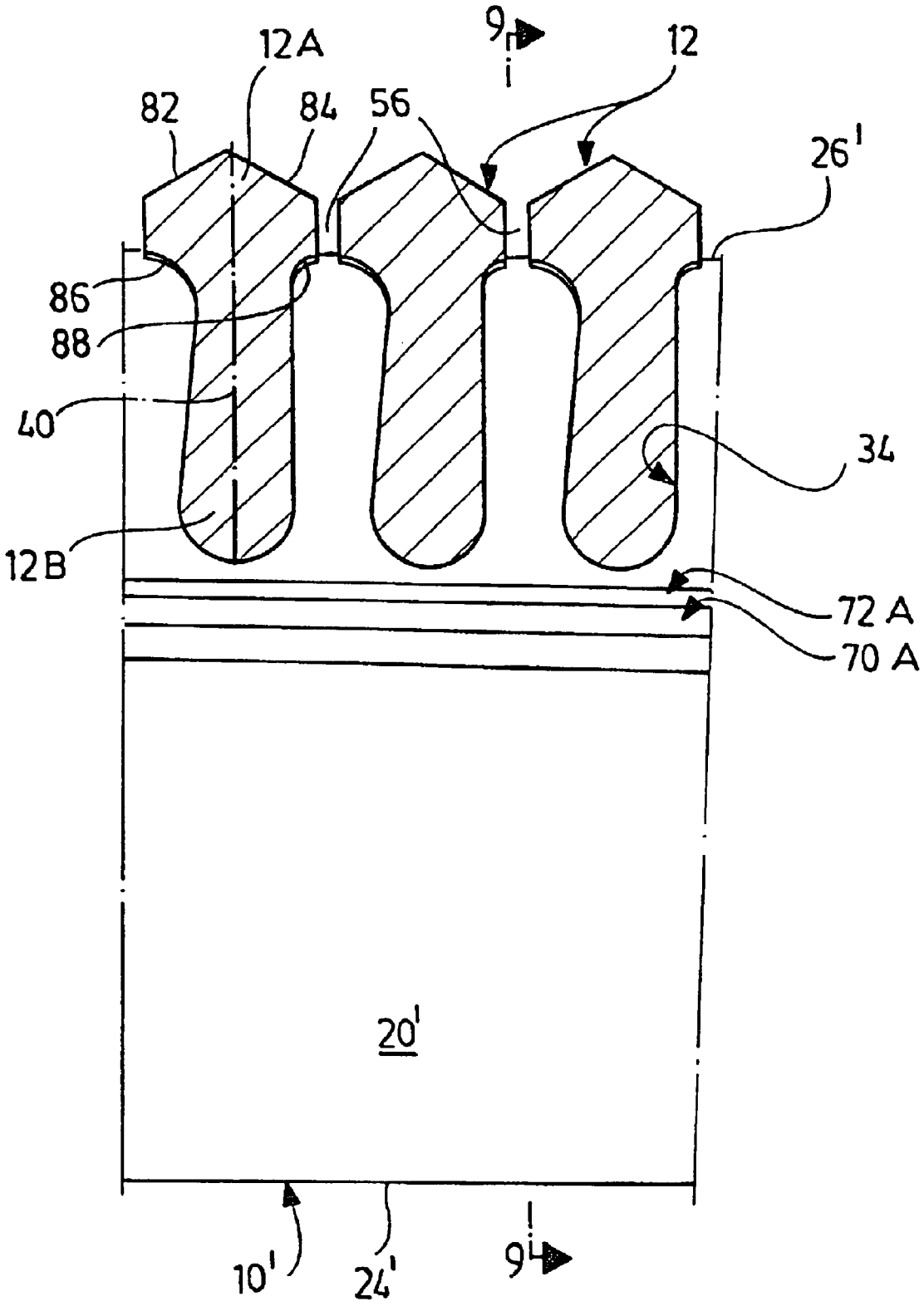
FIG. 8 is a representation corresponding to FIG. 3, but after the inventive plastic deformation of the illustrated profiled bar support for the purpose of displacement of profiled bar support material in the direction towards the profiled bars.

If one assumes that FIG. 8 represents a section taken from FIG. 2 and does not show a profiled bar support 10', but the supporting ring 10, one recognizes that also after shaping of the profiled bar supports 10' into closed supporting rings 10, the profiled bars 12 form between them slot-shaped screen openings 56 which extend parallel to the screen axis 14 and are interrupted by the supporting rings 10. The inlet side 16 of the screen communicates via these screen openings 56 with the outlet side 18 of the screen.

In the first cross-sectional end regions 12A, the profiled bars 12 are provided at the inlet side 16 of the screen at their end faces with inclined flanks 82 and 84 and with rear flanks 86 and 88. The rear flanks 86 and 88 form stops with which the profiled bars 12 lie against the first edge 26 of the supporting rings 10 (see FIG. 8). The inclined flanks 82 and 84 provided at the end faces form with the plane 40 indicated in FIG. 3 acute angles which may be of the same or different size.

In sorters in which a rotor rotates in a known way in the fiber suspension to be sorted close to the inlet side 16 of the screen, the first cross-sectional end regions 12A of the profiled bars 12 generate microturbulences in the fiber suspension to be sorted, in particular, with their inclined flanks 82 and 84;

These microturbulences counteract formation of any appreciable fiber fleece at the inlet side 16 of the screen and any clogging of the screen openings 56.

The profiled bars 12 are preferably made from drawn metallic profiled bars or extruded plastic sections, in which the recesses 50 are made by, for example, milling or grinding. The profiled bar supports or supporting rings also preferably consist of metal, although plastic parts are, in principle, also possible.

It is recommended that the profiled bars be made from a material of higher stability than the stability of the material of the supporting rings or profiled bar supports, above all, when the supporting rings or profiled bar supports have to undergo deformation in order to secure the profiled bars.

A typical bar screen basket according to the invention has in the direction of the screen axis 14 a length of from 40 to 200 cm and profiled bars whose cross section has a length of approximately 6 to 8 mm and a maximum width of approximately 2.5 to 4 mm, and the slot-shaped screen openings delimited by the profiled bars have—measured in the circumferential direction of the screen—a clear slot width of approximately 0.1 mm to approximately 1 mm, in particular, approximately 0.1 to approximately 0.2 mm, with a tolerence of the slot width of preferably only 0.01 mm. The thickness of the supporting rings 10 measured in the direction of the screen axis 14 lies in the order of magnitude of from 4 to 5 mm. From these dimensional relationships and tolerances the difficulty of inserting the profiled bars into the cutouts of the supporting rings or profiled bar supports in the longitudinal direction of the profiled bars without the thin profiled bars being bent while doing so will be apparent.

What is claimed is:

1. Screen for fiber suspensions having a shape which is essentially rotationally symmetrical in relation to a screen axis, with a first and a second circumferential side, one of which forms an inlet side and the other an outlet side of the screen for the fiber suspension, with a series of straight profiled bars arranged at spacings from one another in the circumferential direction of the screen, extending transversely to the circumferential direction of the screen and forming slot-shaped screen openings of identical width between them, the cross sections of the profiled bars each having an elongate shape with a first end region facing away from the second circumferential side of the screen and a second end region facing away from the first circumferential side of the screen, and with several ring-shaped profiled bar supports arranged at spacings from one another in the direction of the screen axis and lying in planes extending perpendicularly to the screen axis, each of the profiled bar supports having in its first edge region facing away from the second circumferential side of the screen a series of cutouts opening towards the first circumferential side of the screen, the shape of the cutouts—viewed in the direction of the screen axis—corresponding to the configuration of the second cross-sectional end regions of the profiled bars lying in these cutouts, and forming at a radial spacing from the first edge of the profiled bar support facing the first circumferential side of the screen an undercut in which a projection of the profiled bar cross section engages so that the profiled bars are held positively in a radial direction in relation to the screen axis and in the circumferential direction of the screen with their second cross-sectional end regions in the profiled bar support cutouts, with the profiled bars preferably projecting with their first cross-sectional end regions in a radial direction over the first edges of the profiled bar supports, wherein the second cross-sectional end region of each profiled bar has for each profiled bar support a recess which decreases the width of the second cross-sectional end region measured in the circumferential direction of the screen, and the recesses of each profiled bar are arranged at spacings from one another corresponding to the spacings of the profiled bar supports and are located outside the profiled bar supports in the finished screen, and wherein the profiled bar recesses are of such configuration that the areas of the second cross-sectional end regions of the profiled bars provided with these recesses are insertable transversely to the longitudinal direction of the pertinent profiled bar into the profiled bar support cutouts at least without any substantial plastic deformation of the profiled bar supports and/or the profiled bars.

2. Screen in accordance with claim 1, wherein the profiled bar recesses are of such configuration that the areas of the profiled bars provided with these recesses are insertable transversely to the longitudinal direction of the pertinent profiled bar into the profiled bar support cutouts without any deformation of the profiled bar supports and/or the profiled bars.

3. Screen in accordance with claim 1, wherein in the finished screen all profiled bar recesses are arranged immediately adjacent to the profiled bar supports.

4. Screen in accordance with claim 1, wherein the length of the profiled bar recesses measured in the longitudinal direction of the profiled bars is at least the same size as the thickness of the profiled bar supports measured in the direction of the screen axis.

5. Screen in accordance with claim 1, wherein the length of the profiled bar recesses measured in the longitudinal direction of the profiled bars is approximately the same size as the thickness of the profiled bar supports measured in the direction of the screen axis.

6. Screen in accordance with claim 1, wherein in a section through a profiled bar extending perpendicularly to the screen axis and through the center of a profiled bar recess the second cross-sectional end region of the profiled bar is delimited by two flanks of the profiled bar extending approximately parallel to one another and approximately perpendicularly to the circumferential direction of the screen.

7. Screen in accordance with claim 1, wherein in a section through a profiled bar extending perpendicularly to the screen axis and through the center of a profiled bar recess the maximum width of the second cross-sectional end region of the profiled bar measured in the circumferential direction of the screen is approximately equal to the minimum width of the cutout of the profiled bar support also measured in the circumferential direction of the screen.

8. Screen in accordance with claim 1, wherein the profiled bars are drawn bars and the profiled bar recesses are milled or ground.

9. Screen in accordance with claim 1, wherein the profiled bar supports have such deformed areas at the side of the profiled bars facing the second circumferential side of the screen that as a result of a displacement of profiled bar support material in the direction towards the first circumferential side of the screen the profiled bar projections are pressed in this direction against the undercuts of the profiled bar support cutouts.

10. Screen in accordance with claim 1, wherein the profiled bars and the profiled bar supports are metallic.

11. Screen in accordance with claim 1, wherein the screen is cylindrical or conical.

12. Screen in accordance with claim 1, wherein the first circumferential side of the screen forms its inlet side for the fiber suspension.

13. Screen in accordance with claim 1, wherein the inner circumferential side of the screen forms its inlet side.

14. Screen in accordance with claim 1, wherein all profiled bars have the same cross-sectional shape, all profiled bar support cutouts have the same configuration, and all profiled bar recesses have the same shape.

15. Screen in accordance with claim 1, wherein the first cross-sectional end regions of the profiled bars are of such configuration that they generate microturbulences in a fiber suspension circulating at the inlet side of the screen.

16. Screen in accordance with claim 1, wherein—viewed in the direction of the screen axis—the undercut of the profiled bar support cutouts forms at that side of the profiled bar support cutout constriction formed by the undercut which faces the second circumferential side of the screen a flank which is inclined in relation to a diameter plane of the screen running through this constriction at such an acute angle ($\alpha$) opening towards the second circumferential side of the screen that self-locking occurs between this flank and a flank of the profiled bar projection pressed against this flank.

17. Screen in accordance with claim 1, wherein the second end region of the profiled bar cross section is of approximately club-shaped configuration.

18. Screen in accordance with claim 1, wherein the first end region of the profiled bar cross section is of approximately mushroom-head-shaped configuration with flanks facing the second circumferential side of the screen and forming stops cooperating with the first edge of the pertinent profiled bar support.

19. Screen in accordance with claim 1, wherein the stability of the profiled bar material is greater than the stability of the profiled bar support material.

20. Method for the manufacture of a screen in accordance with claim 1, wherein the profiled bars are inserted with their areas provided with the recesses into the cutouts of the profiled bar supports in a direction perpendicular to the longitudinal direction of the profiled bars, and the profiled bar supports and the profiled bars are then displaced relative to one another in the longitudinal direction of the profiled bars such that the profiled bar recesses lie outside of the profiled bar supports and the second cross-sectional end regions of the profiled bars lie at least substantially free of play in the profiled bar support cutouts.

21. Method in accordance with claim 20, wherein with the profiled bar recesses lying outside the profiled bar supports, the profiled bar supports are made to undergo such plastic deformation at the side of the profiled bars facing away from the first edges of the profiled bar supports that as a result of a displacement of profiled bar support material in the direction towards the first edges of the profiled bar supports, the profiled bar projections are pressed in this direction against the undercuts formed by the profiled bar support cutouts.

22. Method in accordance with claim 20, wherein the profiled bar supports are only bent into closed rings after insertion of the profiled bars into the profiled bar support cutouts and displacement of the profiled bars and the profiled bar supports relative to one another.

23. Method in accordance with claim 21, wherein the plastic deformation of the profiled bar supports causing the displacement of material is carried out on the ring-shaped profiled bar supports.

* * * * *